United States Patent [19]

Mulholland

[11] Patent Number: 4,584,247

[45] Date of Patent: Apr. 22, 1986

[54] THREADING DEFORMED BARS

[75] Inventor: Jack R. Mulholland, Beaumaris, Australia

[73] Assignee: The Titan Manufacturing Co. Pty. Ltd., Victoria, Australia

[21] Appl. No.: 555,931

[22] Filed: Nov. 29, 1983

Related U.S. Application Data

[63] Continuation-in-part of Ser. No. 294,609, Aug. 20, 1981, abandoned.

[51] Int. Cl.[4] ..... E04C 5/00; B21H 3/02

[52] U.S. Cl. ..... 428/592; 72/103; 52/698; 52/740; 52/737; 10/152 R; 411/411

[58] Field of Search ..... 428/592; 411/411, 424; 405/259, 260; 72/103, 104; 10/1 B, 152 R; 52/737, 738, 739, 740, 698

[56] References Cited

U.S. PATENT DOCUMENTS

| | | | |
|---|---|---|---|
| 3,469,491 | 9/1969 | Munsey | 10/152 T |
| 3,626,733 | 12/1971 | Zook et al. | 10/152 R |
| 4,137,686 | 2/1979 | Kern | 52/740 |
| 4,303,354 | 12/1981 | McDowell | 405/260 |

FOREIGN PATENT DOCUMENTS

| | | | |
|---|---|---|---|
| 11422/43 | 2/1946 | Australia . | |
| 8922/46 | 1/1947 | Australia . | |
| 12990/52 | 12/1952 | Australia . | |
| 13469/52 | 12/1952 | Australia . | |
| 56220/60 | 7/1960 | Australia . | |
| 76807/74 | 6/1976 | Australia . | |
| 2009150 | 9/1971 | Fed. Rep. of Germany | 52/737 |

OTHER PUBLICATIONS

*Journal of the American Concrete Institute,* Nov. 1949, pp. 162, 163.

*Primary Examiner*—L. Dewayne Rutledge
*Assistant Examiner*—John J. Zimmerman
*Attorney, Agent, or Firm*—Lester Horwitz

[57] ABSTRACT

A method of selecting deformed bar for direct rolling of a thread thereon and also a method of threading such deformed bar. The method comprising rolling a preselected thread onto selected deformed bar without machining the bar in preparation. The bar selection is made so that the average cross-sectional area of the bar with the formed thread is substantially equal to that of the unthreaded portions of the bar. The formed thread is of continuous and substantially constant pitch circle. The method is particularly applicable in manufacture of rock bolts and anchor bolts from hot rolled deformed bar.

6 Claims, 4 Drawing Figures

THREADING DEFORMED BARS

This application is a continuation-in-part of application Ser. No. 294,609 filed Aug. 20, 1981, and abandoned on Dec. 1, 1983.

This invention relates to rolling a thread onto deformed bar and has been devised particularly as a method of producing a predetermined uniform male thread of substantially constant pitch circle on hot rolled deformed bar of generally circular cross-section, and with one or more ribs or other deformations on its surface.

Many applications exist where hot rolled or cold rolled bar section, having surface deformations and commonly given the generic name "deformed bar", require a threaded section to be formed thereon. The bar is of the type commonly having a herringbone or chevron pattern of ribs formed on the surface of the bar, frequently in conjunction with one or more longitudinal ribs, and is used in concrete reinforcing applications an in other applications, such as the manufacture of rock bolts for mining and civil engineering purposes.

The existing methods of forming a uniform rolled threaded section on deformed bar require that the deformations be removed prior to threadrolling. (Other threadforming processes, such as cutting, also remove the deformations to produce a standard thread).

One known process normally employed to form this threaded bar when manufactured for use as resin or cement anchored rock bolts will now be described.

Steel form bar (e.g. concrete reinforcing bar to Australian Standard No. AS1302/1977) is sheared to length and turned down to the threadrolling diameter (e.g. 21.7 mm for a 24 mm standard, 14.4 mm for a 16 mm standard thread, etc.) over a length of approximately 160 mm at one end of the bar. A thread is then roll-formed onto the machined portion to enable tensioning in use with a nut. The remaining deformations provide a mechanical lock in the anchor when the bolt is installed.

An alternative process of producing resin or cement anchored rock bolts will now be described. Plain round steel bar is sheared to length and on one end approximately 150 mm of thread is rolled to enable tensioning in use with a nut. At the other end, deformations, typically a thread form extending up to 900 mm along the bolt, are formed to provide a mechanical lock in the resin or cement anchor.

With reference to bolts produced by the first process above, because of the sizes of presently commercially available deformed bar, it is necessary to reduce the shank diameter to that required for the rolling of a male thread thereon, if a standard thread size is required. This system has the disadvantage that it is an expensive operation to remove the deformations and to size the bar before thread-rolling, due to the labour and machinery involved. This method of production has a further cost disadvantage in that, because the strength of the bolt is limited to the strength at its point of smallest cross-section (i.e. the root diameter of the threaded portion) and this diameter is significantly smaller than the effective diameter of the original bar, much of the material in the unmachined part of the deformed bar is thereby wasted. A further disadvantage of this method of production is that when existing deformed bar provided with a threaded end is used as a rock bolt in mining or civil engineering applications, the commercially available patterns of deformations do not provide optimal retention of the resin or cement in the anchor zone, as the rotation of the herringbone or chevron pattern ribs may leave air cavities which reduce the adhesion area and the anchorage strength.

With reference to bolts produced by the second process above (i.e. formed from plain round steel stock), the additional thread for positively keying into the resin or cement anchor on the second end of the bolt is formed at some cost penalty when compared with bolts made from deformed bar and which require only one threaded section. As the middle portion of the bar has no threading or deformations, this limits the flexibility of application in that, if a shorter bolt is required during installation, this bolt cannot be shortened without reducing the bond length of anchorage. Similarly, if an increase in anchorage length is required for a given bolt, a limitation is apparent in that, beyond a certain point, increasing the amount of resin or cement anchor material will not significantly increase anchor strength, as this additional material is in contact with the unthreaded portion of the bar.

It is therefore an object of the present invention to provide a method of producing threaded deformed bar members which will obviate or minimize the foregoing disadvantages in a simple yet effective manner or which will at least provide the public with a useful choice.

Preferably, the method of the invention includes the step of first selecting hot rolled deformed bar of suitable cross-section to permit rolling of the thread configuration desired.

Preferably, said cross-section is such that the volume of material per unit length of said bar is substantially the same as the volume of material per unit length required in said threaded section of bar.

Preferably, said step of selecting deformed bar of suitable cross-section includes selecting a pattern of deformation which will be suitable for use with a hardenable anchor, such as a resin or cement mortar anchor in, for example, a rock bolting or reinforcing situation.

Preferably, said step of selecting a pattern of deformation comprises selecting a pattern of deformation having one or more helical rib deformations on said bar.

Preferably, said step of selecting said pattern of one or more helical rib deformations comprises selecting a helical form or forms of opposite handedness to that of the desired thread.

In a further aspect, the invention may broadly be said to consist in a threaded deformed bar made by the method described in one or more of the preceding paragraphs.

Notwithstanding other forms that may fall within its scope, one preferred form of the invention will now be described with reference to the accompanying figures, in which.

In a preferred form of the invention, a thread is formed on a deformed bar as follows:

The deformed bar (1) is selected having an overall average cross-sectional area substantially the same as the average cross-sectional area that is desired for the threaded section of the bar. This will normally be a standard thread so that easily available co-operative nuts can be used in conjunction therewith. The average cross-sections may easily be compared with one another by measuring the volumes per unit length of the bars. Although the actual shape and pattern of the deformation is not overly restricted, as many shapes possess this geometrical relationship, a specially designed deformed bar section (1) is preferably used, which is particularly suitable for use as a rock bolt in mining or civil engineering operations, in that the configuration of the deformations is designed to be particularly advantageous for the mixing and retention of liquid polyester resin or cement mortar in the anchor zone and improved bonding with the anchor after hardening. In this form of the invention the deformations are formed as two left-handed helical ribs (2) and (4).

Figure 1:
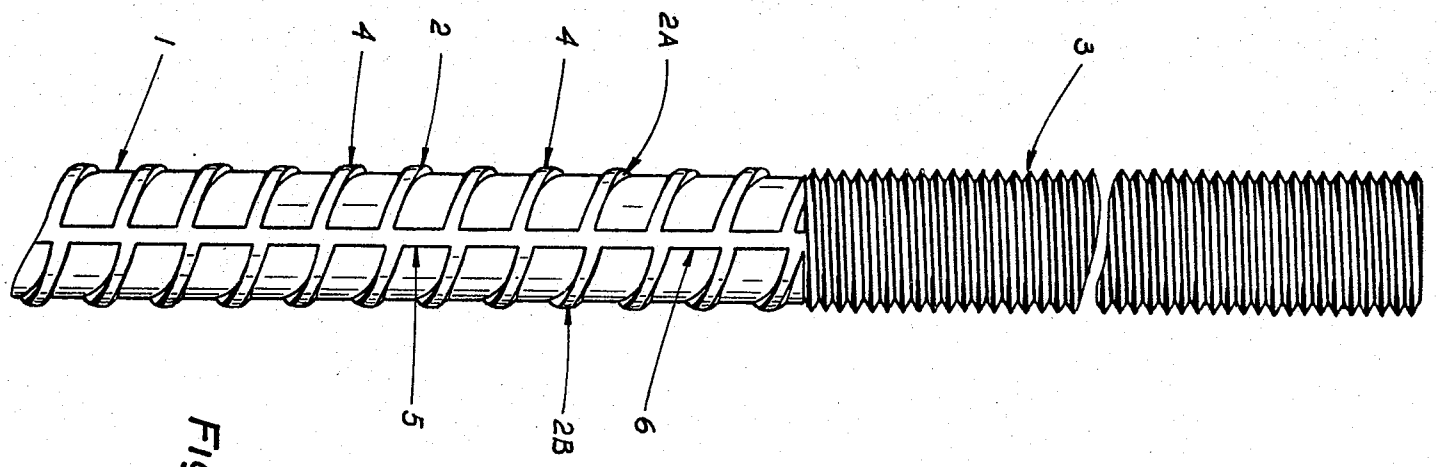
FIG. 1 is a view of a threaded end of a deformed bar according to one aspect of the invention.
Figure 4:
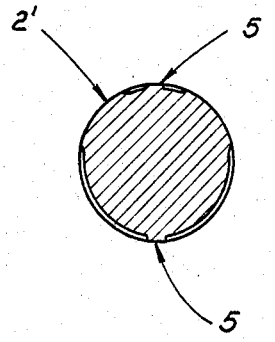
FIG. 4 is a typical cross-section view of a bar taken at line AA of FIG. 2.
Figure 2:
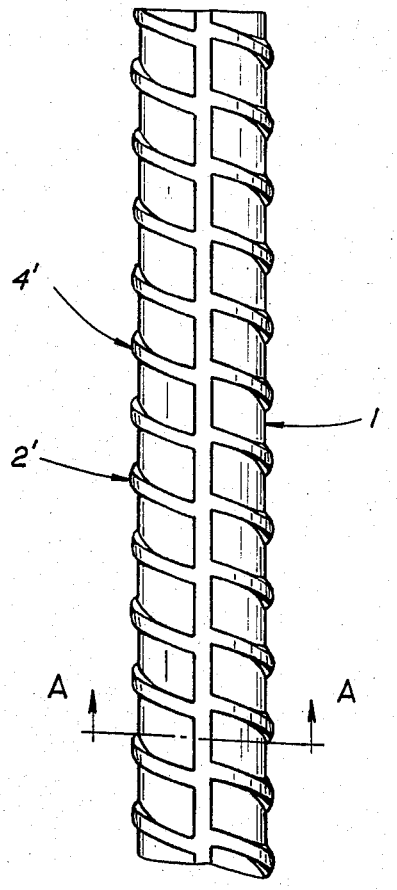
FIG. 2 shows a similar deformed bar before threaded.
Figure 3:
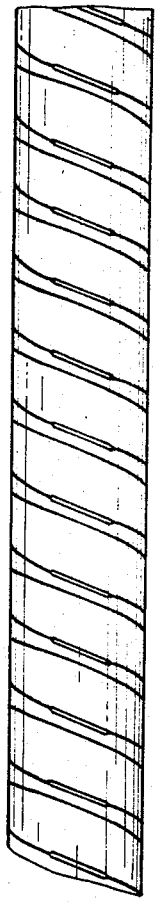
FIG. 3 is a side-elevational view of the bar.

The deformations could alternatively be a single helical rib or three or more ribs. One or more longitudinal ribs (5) may also be provided and the helical ribs (2) and (4) may possess a discontinuity where they abut ribs (5) at junction (6) as shown by the mismatching of portions (2A) and (2B) of rib (2). As shown in FIG. 2, the helical ribs may be quite discontinuous at a longitudinal rib. The helical ribs (2) and (4), are chosen to be of opposite handedness to that of the required thread. The bar (1), is then inserted in a threadrolling machine without any further treatment and the right-hand threaded section (3) is rollformed onto the bar. Neither the deformations (2) and (4), nor the longitudinal rib (5) are removed by turning, swaging or rolling before the threaded section (3) is formed and the bar is not sized by turning, swaging or rolling or the size required before the threadrolling operation is performed.

The threadrolling operation displaces, by cold deformation, material from the original ribs (2), (4) and (5), and forms this material and other material from the body of the bar into the form of a thread, the thread thus produced being able to accept a female threaded coupling, e.g. a nut. In this manner a method of producing a threaded deformed bar is performed which enables the threaded portion to be formed quickly and cheaply with a minimum of manufacturing time and no wastage of raw material. Clearly in mining and other civil engineering applications the thread must be of considerable strength. This is achieved in the present invention because the thread formed is a continuous thread of substantially constant pitch circle. This differs from prior known threadrolling directly onto deformed bar or rod which has resulted in intermittent threads such as those of self-tapping screws.

The most successful bars threaded according to the present invention have been hot rolled with external ribs. The bars have been produced to have an average volume per unit length equal to the average volume per unit length of a regular bar to which the desired thread has been applied. This produces deformed bar which has an average cross-sectional area equal to the average cross-sectional area of the desired threaded portion, thus no material is wasted. By using ribbed bar (rather than grooved bar) only small amounts of material needs to be plastically deformed in order to obtain the desired threads. Further, by using hot rolled deformed bar stock which is in a normalized state the necessary plastic deformation is easily obtained.

The preferred embodiment has left-handed helical ribs (2) and (4) with a right-handed thread (3), but the ribs would desirably be right-handed if a left-handed thread was used. The reasons for this opposite handedness of ribs relative to threads are, firstly the thread is far easier to form and, secondly when resin anchored rock bolts are used it is often the practice to mix the contents of a resin anchor cartridge by rotating the bolt in the same direction as that for tightening the nut, whereupon if the thread and the helical ribs were of the same handedness, the resin or cement anchor material would tend to flow away from the top of the hole due to the screw action. In the preferred embodiment, any screw action would tend to retain the resin or cement anchor material in the hole.

Known bolts from deformed bar, because of their substantially reduced diameter at the threaded region, have an overall strength that is considerably less than that of the original bar. As a method according to the present invention does not require the removal of material in the area to be threaded, it provides a bar or bolt of improved strength or, alternatively, allows less material to be used in the manufacture of bolts of a given strength, so giving considerable cost savings.

Standard concrete reinforcing bar may also be threaded in a manner according to the present invention. Rods used in concrete reinforcing bars are generally obtained in standard sizes, e.g. to Australian Standard No. AS1302/1977. Any thread thus formed, however, would not be to any standard known to us and special nuts would be required to be produced.

Threaded bolts produced by the above described method possess characteristics which differ from those possessed by known bolts produced from deformed bar after removing deformations and sizing as follows:

1. For known bolts the average diameter of the threaded portion would be less than that in the deformed part of the bar. This can be simply determined by comparing the weight per unit length of each section.
2. Threadrolling dies are not normally completely "filled" with material during the threadforming process. Therefore when threads are being rolled directly onto a deformed bar a slightly fuller thread is formed at the point of coincidence between a hollow in the forming die and a deformation on the bar being threaded. Although this does not result in any variation in the strength of the thread so formed, the slight difference in height of individual threads is detectable.
3. For known bolts a portion of the machined section is normally visible between the threaded section and the unmachined deformed section as it is provided as clearance between the threadrolling dies and the deformed part of the bar.

What we claim is:

1. A hot rolled steel deformed standard threaded bar comprising at least one end thereof a portion having a plurality of substantially regular surface deformations and at the other end of said bar a threaded portion having a continuous uniform standard thread of substantially constant pitch circle formed thereon by rolling, using conventional techniques, a bar portion originally having a plurality of deformations substantially identical with those contained on said at least one end of said bar, the average volume per unit length of material in the threaded portion of said bar being substantially equal to the average volume per unit length of material in the deformed portion of said bar.

2. A steel bar as defined in claim 1 wherein said surface deformations comprise helical ribs about the surface of said bar of opposite handedness to said thread.

3. A method of forming a standard thread of substantially constant pitch circle onto a hot rolled deformed bar comprising the steps of: selecting hot rolled deformed bar having a plurality of substantially regular surface deformations in the form of raised portions or ribs along at least one end thereof, said deformations individually and collectively being shaped and sized so that the average volume of material contained in the bar including the deformations per unit length of said bar is substantially equal to the average volume of material required in the threaded section of the bar per unit length of bar when threaded, whereby a uniform standard thread of predetermined configuration and substantially constant pitch circle may be rolled thereon by conventional thread rolling techniques without performance of an intermediate step between bar selection and threadrolling production; and thereafter using conventional threadrolling techniques to thread said bar with a predetermined thread of substantially constant pitch circle over so much of the length of said bar as is desired to be threaded using the said deformations originally provided thereon without the performance of an intermediate step between bar selection and thread rolling.

4. A method as defined in claim 3 wherein said step of selecting said deformed bar includes selecting bar in which said plurality of surface deformations is formed by one or more helical rib deformations of opposite handedness to said thread.

5. A threaded deformed bar made by a method as defined in claim 3.

6. A threaded deformed bar made by the method as defined in claim 4.

* * * * *